US006098658A

United States Patent [19]

Toukonummi

[11] Patent Number: 6,098,658

[45] Date of Patent: Aug. 8, 2000

[54] METHOD AND APPARATUS FOR FILLING A PULP TOWER

[75] Inventor: Olavi Toukonummi, Hajala, Finland

[73] Assignee: Ahlstrom Pumput Oy, Karhula, Finland

[21] Appl. No.: 09/171,173

[22] PCT Filed: Apr. 15, 1997

[86] PCT No.: PCT/FI97/00233

§ 371 Date: Dec. 30, 1998

§ 102(e) Date: Dec. 30, 1998

[87] PCT Pub. No.: WO97/39181

PCT Pub. Date: Oct. 23, 1997

[30] Foreign Application Priority Data

Apr. 18, 1996 [FI] Finland ..... 961692

[51] Int. Cl.[7] ..... D21C 7/06

[52] U.S. Cl. ..... 137/592; 162/17; 162/52; 162/246

[58] Field of Search ..... 137/592; 162/17, 162/52, 246, 248

[56] References Cited

U.S. PATENT DOCUMENTS

| | | | |
|---|---|---|---|
| 1,745,206 | 1/1930 | Cahow | 137/592 X |
| 3,428,061 | 2/1969 | Graham | 137/592 X |
| 3,503,384 | 3/1970 | Matarazzo et al. | 137/592 X |
| 3,552,435 | 1/1971 | Andersson et al. | 137/592 |
| 3,964,962 | 6/1976 | Carlsmith | 162/246 X |
| 4,146,087 | 3/1979 | Johansson | 137/592 X |
| 5,319,902 | 6/1994 | Seppa | 162/246 X |

FOREIGN PATENT DOCUMENTS

| | | | |
|---|---|---|---|
| 0028596 | 2/1985 | Japan | 162/246 |
| WO 93/09059 | 5/1993 | WIPO . | |

*Primary Examiner*—John Rivell
*Attorney, Agent, or Firm*—Nixon & Vanderhye P.C.

[57] ABSTRACT

Pulp is effectively and simply fed into a pulp tower using at least one feed pipe having a number of openings that are spaced different distances from the bottom of the pulp tower. The opening through which the pulp being fed into the tower flows automatically changes depending on the level of the existing pulp in the tower. The feed pipe may have a wide variety of different configurations with openings formed or shaped in different manners, and baffles or similar guides can be used to uniformly spread the pulp being fed through the feed pipe onto the top surface of the existing pulp without mixing. This configuration allows the amount of pulp pumping energy to be minimized while still effectively feeding pulp into a tower.

26 Claims, 3 Drawing Sheets

METHOD AND APPARATUS FOR FILLING A PULP TOWER

CROSS REFERENCE TO RELATED APPLICATION

This application is a U.S. national phase of PCT Application PCT/F197/00233, filed Apr. 15, 1997.

BACKGROUND AND SUMMARY OF THE INVENTION

The present invention relates to a method and apparatus for filling a pulp tower. The invention is especially well applicable in the wood processing industry to filling high consistency pulp towers and corresponding storage towers containing fiber suspension.

Pulp towers used in the wood processing industry are, as know, most commonly tanks containing high-consistency pulp, the consistency being 10–20%, although pulp at a lower consistency is also used occasionally. These tanks are used for example for storing pulp or as blow tanks of some apparatus, i.e. for example for storing pulp which comes in batches from batch digesters, the pulp being then used as a uniform flow in the subsequent treatment apparatus. In other words, it is characteristic of towers according to the invention that the level thereof varies to a great extent, although they most commonly have an optimum level, and the intention is to keep the surface of the pulp at this level.

Several different arrangements for filling pulp towers of the above-mentioned type are known from the prior art. One of the oldest methods known is pumping the pulp to the top of the tower, wherefrom it is allowed to drop down more or less directly. If the pulp is allowed to drop directly onto the pulp below, it goes without saying that the pulp dropping from high above permeates the surface of the pulp in the tower and penetrates deep down into the old pulp. There are several drawbacks to this. For the first, if a dilution of the pulp is performed in the lower portion of the tower, as is very often the case, the pulp fed to the tower may permeate as far as to the dilution zone. This results in the pulp discharging uncontrollably to the dilution zone and the dilution not being as uniform as would be required for the apparatus following the tower. Another problem is that the pulp, when permeating into the old pulp, is drifted closer to the discharge opening of the tower than the pulp already present in the tower, whereby the content of the tower does not change uniformly, but part of the pulp passes out of the tower within some minutes, whereas another part may have to stay in the tower even as long as several weeks. This, in turn, brings about more problems. For the first, it is impossible to even imagine that pulp staying in a tower for days or even weeks could be of the same quality as fresh pulp. For the second, a complete change of stock in towers like this may take days and at least several hours, the pulp discharged from the tower being thus a mixture of old and new pulp of this time span. Depending on the following object of use of the pulp, this "intermediate pulp" may in the worst case be totally unusable. Furthermore, the old pulp staying longer in the tower and the new pulp permeating deeper into the tower, liquid is gradually filtered from the surface of the pulp layer, whereby the surface layer hardens and gets thus damaged more easily. Finally, energy consumption may also be mentioned as a problem, at least from the point of view of our invention, since pumping the whole production volume of a pulp mill, i.e. about 1,000 tons of pulp per day, to the height of 20–30 meters, only to be dropped down to the height of about 3–10 meters, can be regarded as wasting of pumping energy. In other words, the pumping energy that would be really needed is most often less than half of the energy now used.

It is of course possible (U.S. Pat. No. 3,964,962) to discharge the pulp onto a distributing device, for example onto a rotating plate arranged in the upper portion of the tower, by means of which plate the pulp is distributed more uniformly all over the cross-section of the tower. Part of said problems may be solved in this way, but pumping energy is still consumed to the same extent as before, and in addition, the arrangement of distributing devices of pulp in the upper portion of the tower results in both complicated structures and great energy consumption. As the distributing device decomposes the pulp flow into drops, or at least into relatively small particles, a significant amount of air is bound to the pulp during the down-drop, which air will have to be removed at later states of the process by means of vacuum pumps consuming a great deal of energy, or by means of corresponding arrangements.

In connection with some towers, it has been taken into account that the tower is rarely full, and therefore the energy consumption may be decreased by leading the feed pipe of the pulp from the side of the tower into the inside thereof. If the feed pipe is above the pulp surface, the pulp being supplied through the supply opening penetrates through the surface of the pulp layer in the tower into the pulp column at least within some distance, whereby the same problems with pulps of different ages still exist even if they are not as difficult as in the towers filled from the top.

The next alternative is to dispose the feed pipe on the side of the tower below the pulp surface, though directed in such a way that the pulp is supplied substantially onto the pulp layer in the tower. This arrangement works exactly as long as the surface level in the tower remains unchanged. If the surface level varies several meters, the problem may be, for example, that the pulp fed into the tower remains several meters below the pulp surface, whereby the pulp on the surface level cannot discharge, and the new pulp being fed passes first to the discharge. Correspondingly, if the surface level drops a lot below the feed opening, the pulp being fed into the tower penetrates deep into the pulp layer, causing the very problems described above. In other words, this method of feeding is suitable for such cases only where the surface level of the tower remains relatively stable.

Another problem relating to the filling of pulp towers emerges in connection with batch cooking processes, and in particular with the filling of the blow towers thereof. It is generally known that when emptying a batch digester, the consistency of the pulp being discharged from the digester varies to a great extent. Hereby, areas of pulp having different consistencies are formed also in the blow tower, no matter by which prior art method it is filled, and this leads in most cases to variation in the consistency of the pulp directed to the process stage following the tower. This, in turn, causes various problems in brown stock washing, for example. As known, for example washers are dimensioned for an optimum consistency and deviating from this inevitably weakens the operation result.

Various problems caused by the prior art arrangements described above can be solved by means of the method and apparatus of our invention, the characteristic features of which become apparent from the appended claims.

BRIEF DESCRIPTION OF THE DRAWINGS

In the following, the invention is described in more detail with reference to the appended figures, of which

DETAILED DESCRIPTION OF THE DRAWINGS

Figure 1:
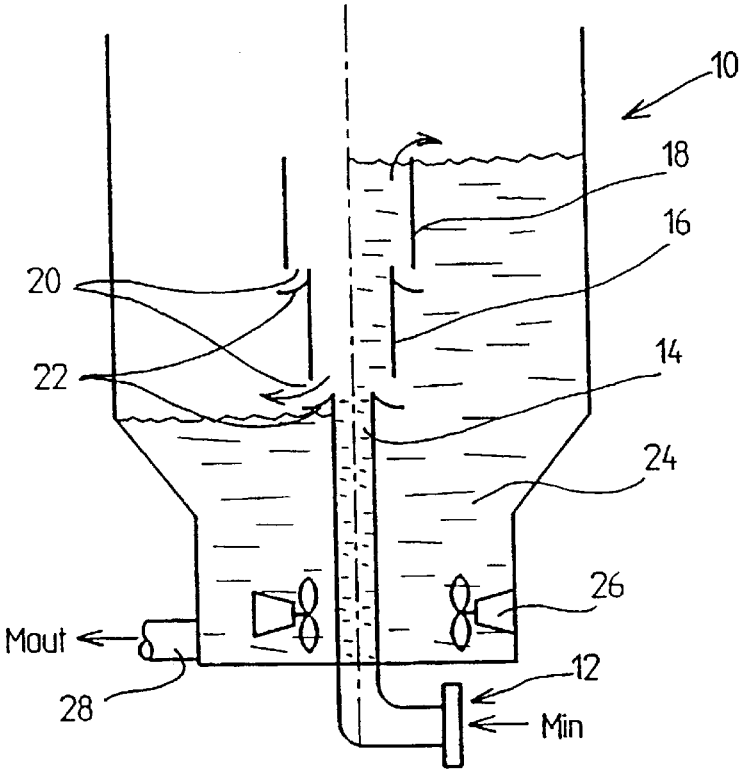
FIG. 1 illustrates an apparatus in accordance with a preferred embodiment of the invention in two different applications.

In accordance with FIG. 1, the apparatus according to the invention comprises a substantially vertical feed pipe 12 arranged centrally within a pulp tower 10 through the bottom thereof. The feed pipe 12 extends preferably at least to such a height in the tower in which the pulp level varies under normal conditions. In other words, the upper end of the pipe 12 is located in the tower somewhat above the upper limit of the variation span of the normal surface level. In the embodiment of FIG. 1, the pipe 12 is formed by portions 14, 16 and 18, the diameters of which enlarge upward. At the attachment point of the portions, pulp supply openings 20 are arranged which open either, as illustrated in the figure, to the side, directed by baffles 22 arranged at the upper parts of the narrower pipe portions, respectively, or directly downward without said baffle.

The apparatus functions in such a way that when pulp is pumped into the tower 10 through the feed pipe 12, the pulp already in the tower 10 clogs supply openings 20, so that the new pulp flows in the feed pipe upward past the openings (the right-hand side of FIG. 1), until it discharges either through the first unclogged supply opening, or to be more precise, through the first opening through which the flow resistance is insignificant enough for the kinetic energy of the pulp to overcome the resistance, or from the upper end of the pipe onto the surface of the pulp already in the tower 10. The spacing between the supply openings 20 in the feed pipe 12 are preferably adjusted such that the pulp discharging from the openings 20 does not have time to generate a significant downward velocity component which would promote the penetration of the pulp deep into the "old" pulp. Preferably, the spacings between the supply openings 20 in the vertical direction are in the order of 1–2 meters, the surface area being in the order of (0.5 –2) * the diameter of the feed pipe. One preferable way to dispose the supply openings is to arrange them as squares standing on their corners and to position them alternatingly around the pipe, so that, practically speaking, one or more openigs are all the time at the point of the free pulp level. Corresponding positioning may also be effected by means of openings of other shapes, for example by rectangular or round openings or openings with curved edges. The diameter of the feed pipe 12 is determined according to the capacity of the tower, varying in conventional towers preferably most often between 0.5–1 meter. The left-hand side of FIG. 1 illustrates a case in wich the surface of the pulp in the tower 10 is relatively low, whereby the pulp discharges onto the pulp surface from the supply opening 20 disposed lower in the pipe 12, preferably in such a way that due to the effect of the baffle 22 it forms a shape of a fan in the direction of the pulp surface in the tower. In the bottom portion 24 of the tower 10, a dilution zone of the pulp, which is most often located just there, is shown with a mixer 26 and a discharge opening 28 thereof. The tower 10 may also be provided with other types of dilution and/or discharge apparatus which may also be arranged in another way without affecting the operation of the invention.

Figure 2:
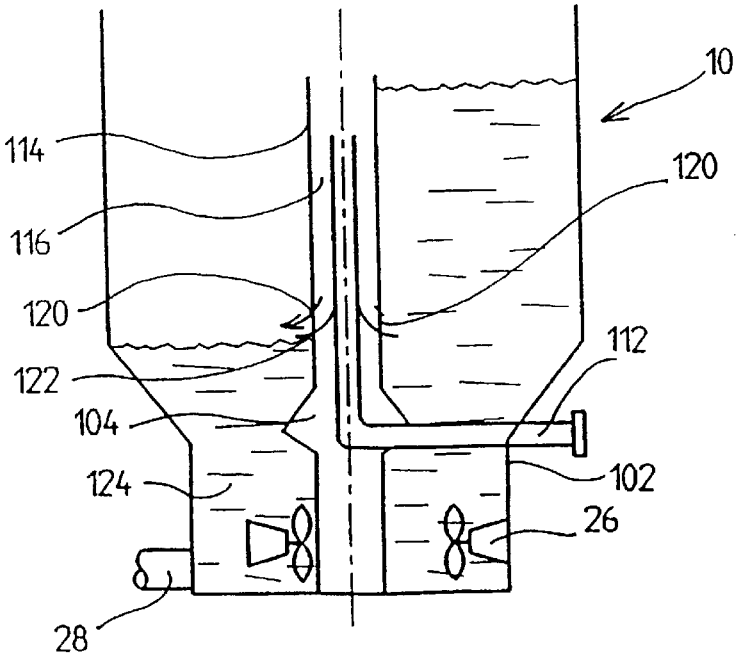
FIG. 2 illustrates an apparatus in accordance with a second preferred embodiment of the invention in two different applications.

FIG. 2 illustrates an apparatus according to a second preferred embodiment according to the invention, which apparatus has been modified to be used with a bottom pillar, the use and operation of which is described in more detail in FI patent application 94709. In the embodiment of FIG. 2, the pulp is introduced into the tower 10 from a side wall 102 of the bottom portion 124 thereof (most commonly from either a conic or cylindric part), although in connection with our invention the pulp may as well be introduced through the lower end of a bottom pillar 104. Now, however, the feed pipe 112 for the pulp may serve as one of the supporting structures of the bottom pillar 104, if it is considered that supporting structures are required. In the embodiment of the figure, a feed pipe 112 bends at the point of the extension of the bottom pillar 104 in the vertical direction and extends upward within a pipe 114 having a larger diameter and extending upward at the upper end of the bottom pillar 104. The feed pipe 112 extends in this embodiment close to the larger pipe 114, which is, relative to the level of the tower, located preferably at the same height as the upper end of the feed pipe 12 illustrated in FIG. 1, in other words at the same height as the upper end of the largest part of the pipe 12.

The apparatus according to FIG. 2 operates in such a way that when the pulp surface is high (the right-hand side of the figure), the pulp being fed passes from the upper end of the feed pipe 112 into the larger pipe 114 and further from the upper end thereof onto the pulp layer in the tower 10. When, on the other hand, the surface is lower (the left-hand side of the figure), the pulp passes from the feed pipe 112 into an annular space 116 between the feed pipe 112 and the larger pipe 114 and therefrom through a supply opening/openings 120 onto the pulp layer in the tower. In this embodiment, too, there are baffles 122 in connection with the supply openings 120, by which baffles the pulp is discharged in the substantially radial horizontal direction onto the pulp layer.

The above-described feeding method is especially advantageous when a change of stock is performed in the tower, in which case it is essential to be able to discharge the former stock from the tower in such a way that as little of it as possible is mixed with the new stock. By means of the method according to our invention the change of stock takes place simply in such a way that the pulp level in the tower is moved to a low position, somewhat below the supply openings 120, as illustrated by the left-hand side of FIG. 2. When beginning to feed new stock to the tower 10, it is possible to take advantage of the difference in height between the feed pipe 112 and the supply openings 120 as well as of the baffles 122 of the supply openings in such a way that the pulp being supplied from the feed pipe 112 into the space 116 has a relatively great flow velocity in the space 116 when being dropped from the level of the upper end of the feed pipe 112 to supply openings 120, whereby it is supplied through the openings 120 directed by the baffles 122 at rather a great horizontally directed velocity onto the surface of the pulp in the tower 10. Thus, when changing the stock, the new pulp coming to the tower 10 is settled as a uniform layer on the old stock, which means that the time spent on the change of stock may in the best case be calculated in minutes and not in hours, days, or even weeks, as in connection with prior art pulp towers. Also in FIG. 2, a dilution zone usually located in the bottom portion 124 is shown therein with a mixer 26 and a discharge opening 28. However, the tower 10 may be provided with other types of dilution and/or discharge apparatus which may be arranged in another way without affecting the operation of the invention.

Furthermore, it is worth mentioning about the pipes used that instead of being composed of several pipes having different diameters, the feed pipe 12 may in the embodiment of FIG. 1 also be a cone enlarging upward, on the wall of which the supply openings are arranged. Correspondingly, the feed pipe 112 in FIG. 2 could be a cone enlarging upward, which would mean that while the larger pipe is cylindrical, the space 116 between the pipes would be an annular space enlarging downward. By this method it could be ensured that the pipes will not clog even if the pulps used are difficult to handle.

As regards the saving in energy consumption achieved by using the apparatus according to the invention, this may be optimized by controlling the lift height of the pump arranged in connection with feed pipes 12, 112 according to the level of the tower 10. In practice, this means chiefly the controlling of the rotation velocity of the pump.

Figure 3:
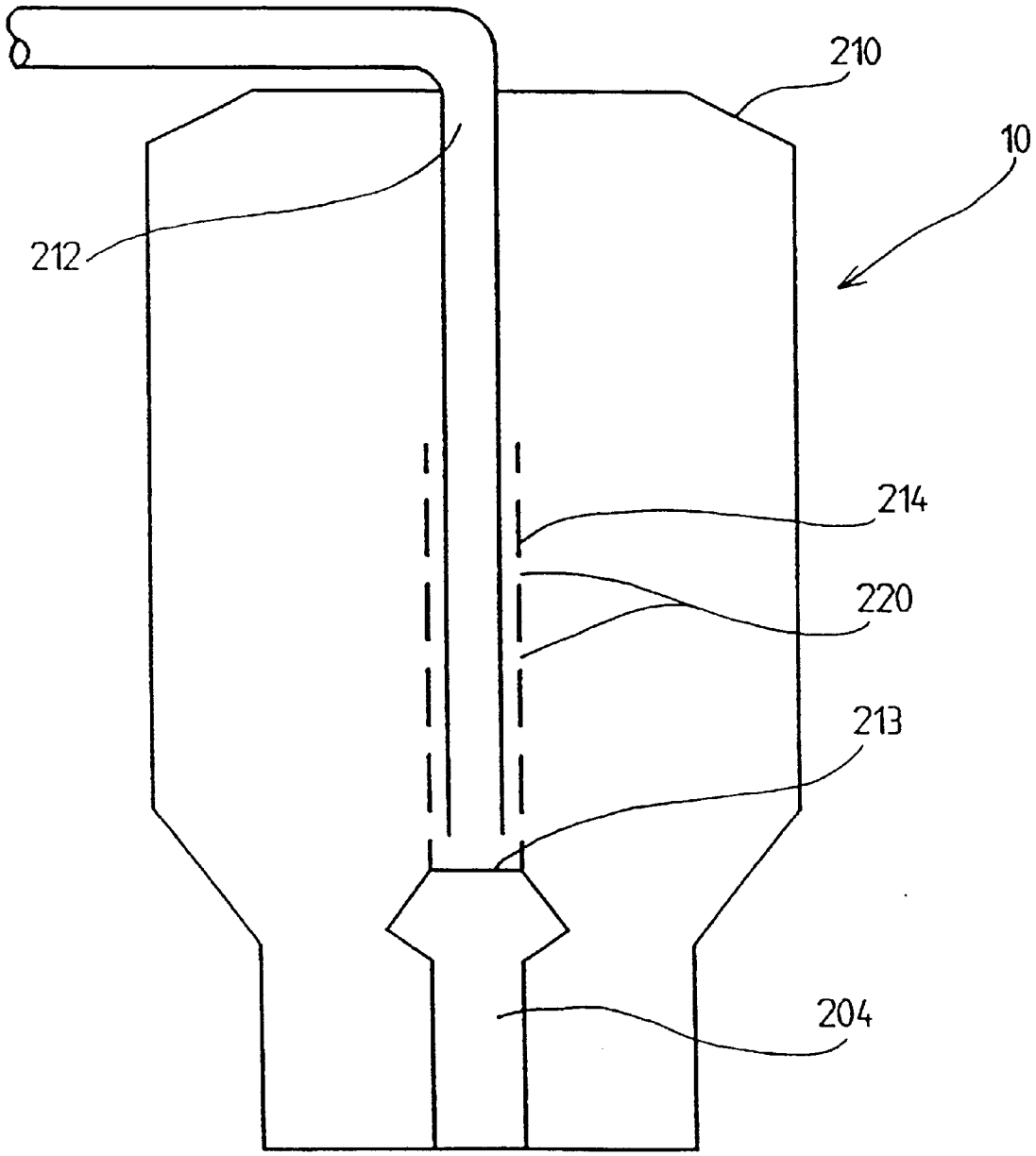
FIG. 3 illustrates an apparatus in accordance with a third preferred embodiment of the invention in two different applications.

It is yet to be noted that in some cases the feed pipe may be led into the tower also through the roof thereof, for example when discharging the pulp into a storage tower from a bleaching tower having an upward-directed flow without an intermediate pumping (by the pressure of the feed pump of the bleaching tower), for example, but in such a case good care has to be taken that the pulp discharge from the feed pipe will not penetrate deep into the old pulp. This may be ensured by an arrangement according to FIG. 3, for example, showing that the roof 210 of the tower 10 is provided in this embodiment with a central pulp feed pipe 212 extending to some distance from the bottom of the tower, which bottom is provided with a bottom plate 213. In the embodiment of the figure, the bottom plate 213 is arranged in connection with a bottom pillar 204, but in practice it may as well be supported by other means. From the same bottom plate 213, a pipe 214 extends concentrically with the feed pipe 212. The pipe 214 has a larger diameter and is provided with supply openings 220 all the way up the pipe 214. The operating principle is as in connection with the previous embodiments. In other words, the pulp is fed to the tower 10 through the feed pipe 212. The pulp bumps against the bottom plate 213, changes its direction, begins to flow upward within the larger pipe 214 and discharges through the first openings that are unclogged, or through the first openings at which the flow resistance is so low that the kinetic energy of the pulp is sufficient to overcome it.

Another way to effect the filling of a pulp tank is to arrange a movable bottom in the feed pipe, which bottom moves according to the pulp level surrounding the feed pipe, so that the supply opening positioned closest to and above the bottom is at least at the same level as the pulp surface, whereby the pulp flow discharging through the opening always ends up upon the pulp layer already in the tower.

Figure 4C:
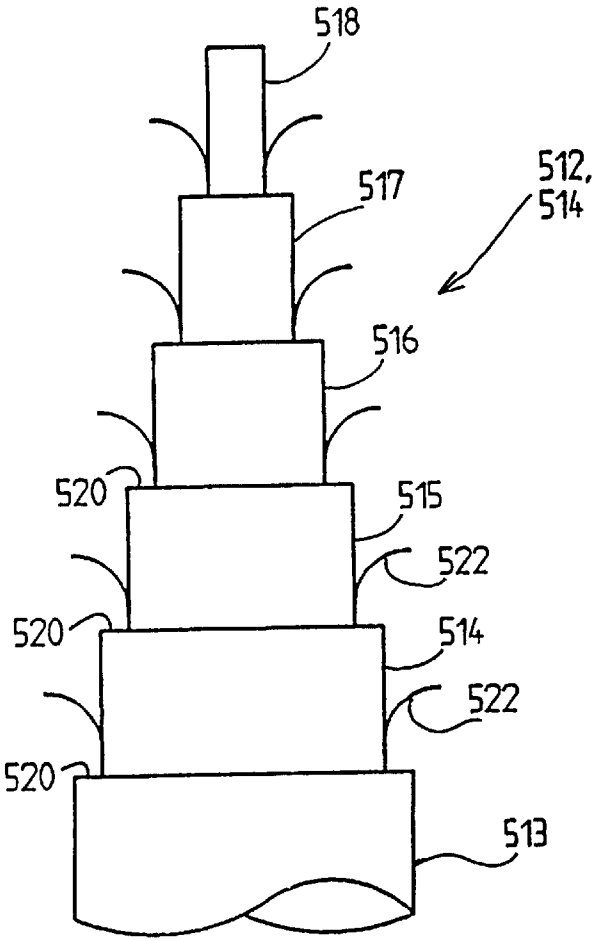
FIGS. 4*a–c* illustrate details in accordance with some other preferred embodiments of the invention.
Figure 4B:
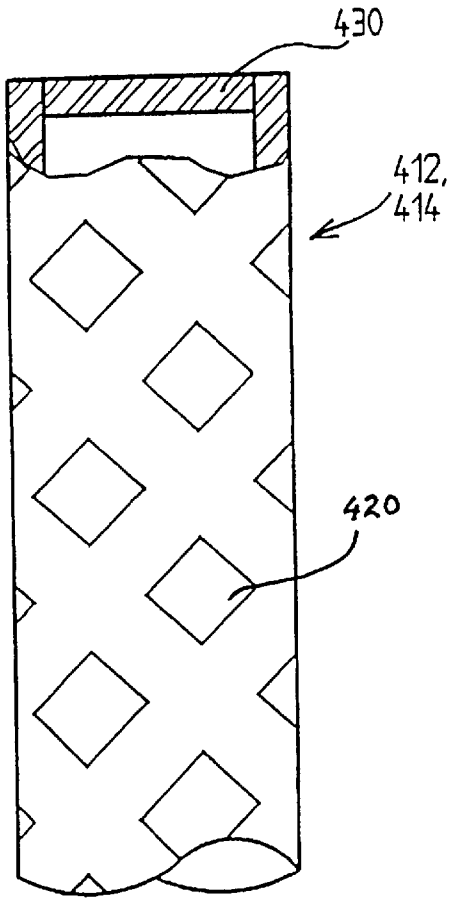
Figure 4A:
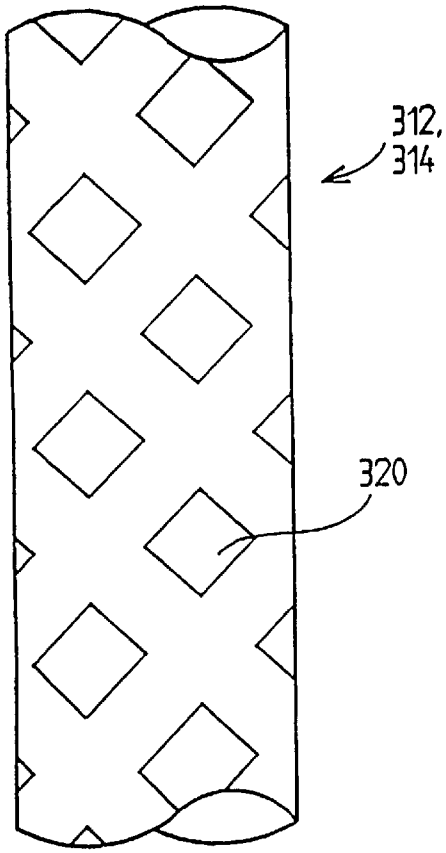

FIGS. 4*a* and 4*b* illustrate a feed pipe in accordance with a preferred embodiment of the invention, or actually a feed pipe applicable to solving two in a way opposite problems. By only minor changes the feed pipe may be modified to solve one problem or the other. A feed pipe 312 illustrated in FIG. 4*a* is used in the manner already described in connection with FIG. 1. In other words, when feeding pulp from below into the feed pipe, the pulp begins to discharge from the pipe into the tower through the first unclogged supply opening 320, or from the supply opening having a sufficiently low flow resistance. In practice, the pulp hereby ends up substantially upon the pulp already present in the tower.

In the case illustrated by FIG. 4*b,* a feed pipe 412 is as in FIG. 4*a,* except that in the embodiment of FIG. 4*b* the upper end of the feed pipe 412 is closed by a cover 430 preventing the discharge of pulp through the upper end of the pipe. By means of this application it is possible to solve the above-described problem, i.e. the generation of areas with different consistencies in the blow tower of a batch digester. The solution is to mix the pulp already at the filling stage of the blow tower. This works in such a way that as the discharge of the pulp through the upper end of the feed pipe 412 is prevented, the pulp discharges into the tower at several different levels through supply openings 420, whereby the tower is filled practically speaking uniformly. Naturally, the uniformity of the filling may be improved in many ways. One alternative is to decrease the size of the feed pipe openings toward the upper end of the pipe. In other words, by decreasing the size of the openings, flow resistance is generated at the points where it would otherwise be lower due to the proximity of the pulp level. Another way is to arrange a movable cover system in the feed pipe 412, in which the cover moves according to the rise of the pulp level either directly or with a delay (the cover being lower than the pulp level). The above-mentioned alternatives may of course be combined, in other words supply openings of changing sizes may be used together with a movable cover in the same feed pipe. The closer the method used is to such a combination, the closer one gets to an optimum situation, where there would be a uniform supply of pulp into the pulp already in the tower, extending through the whole height of the pulp layer.

FIG. 4*c* illustrates yet another alternative for filling the blow tower following a batch digester. In this embodiment a feed pipe 512 is substantially similar to the pipe in FIG. 1. In other words, the feed pipe 512 is formed by portions 513–518 having different diameters. The only difference is that the pipe 512 narrows upward. In other words, each opening 520 at the point of the change in diameter cuts part of the pulp being fed into the tower and a baffle 522 disposed above the opening 520 directs the coming pulp flow to the side to be mixed into the pulp already present in the tower.

Should the blow tower of a batch digester be of a type which is filled from above, all the arrangements according to the embodiments illustrated in FIGS. 4*a,* 4*b* and 4*c* may be applied in the manner presented already in previous embodiments. For said reason, among other things, FIGS. 4*a,*4*b* and 4*c* are provided with both reference numerals, in other words the reference numeral ending in −12 denoting a case where the pipe is a so called feed pipe, and the numeral ending in −14 denoting a case where the pipe is a so called larger pipe. In FIG. 4*c,* for example, the illustrated embodiment may be modified for feed taking place from above in such a way that the lower end of the pipe portion 514 is closed by a plate, which can rest for example upon a bottom pillar in the manner illustrated in FIG. 3. Hereby, the pulp is introduced from above, for example through a pipe portion 518, which would in this case extend close to the bottom plate, and is discharged against the bottom plate turning the pulp flow upward, after which the operation continues as described above.

As becomes obvious from the above description, a new method and apparatus for filling pulp towers has been provided, by which method the drawbacks of the prior art apparatus and methods can be avoided. However, only a few preferred embodiments of the invention have been presented above, and the intention is not to reduce the scope of the invention but to interpret it according to what is presented in the appended claims. Thus, it is for example possible to arrange more than one feed pipe in the tower, if desired, for example in the manner described in FI patent 94442 and using a distributing device described above, whereby it can be ensured that the pulp is distributed uniformly all through the cross-section of the tower. Furthermore, it has to be noted that the shape of the tower does not, by all means, have to be as described in the appended figures, i.e. a tower having a cylindric bottom portion narrowed by a conic intermediate part, but it may as well be totally cylindric and provided with either an even or inclined bottom, or a conic or semispherical bottom portion. In other words, the filling method according to the invention is applicable to filling towers of any shape.

What is claimed is:

1. A method of filling a substantially vertical pulp tower having a bottom and side wall, using at least one feed pipe having a plurality of openings spaced different distances from the bottom of the tower, said method comprising:

(a) feeding pulp into the feed pipe so that the pulp flows into the tower through the first opening from the bottom through which the flow resistance caused by pulp existing in the tower is insignificant enough for the kinetic energy of the pulp to overcome the flow resistance, the opening through which the pulp being fed flows automatically changing depending upon the level of existing pulp in the tower.

2. A method as recited in claim 1 wherein (a) is practiced by uniformly feeding the pulp through the at least one feed pipe so that the pulp uniformly flows on top of the existing pulp in the tower.

3. A method as recited in claim 1 wherein pulp existing in the tower has a top surface; and wherein (a) is practiced by spreading the pulp uniformly onto the surface of the existing pulp substantially without mixing of the pulp being spread with the existing pulp.

4. A method as recited in claim 1 wherein (a) is practiced by pumping the pulp into the at least one feed pipe to flow upwardly in the feed pipe; and further comprising (b) adjusting the pumping energy for pumping the pulp into the at least one feed pipe dependent upon the opening through which the pulp flow from the at least feed pipe into the tower to minimize the amount of energy necessary for pumping.

5. A pulp tower comprising:

a bottom and a side wall, defining a tower interior;

a pulp discharge apparatus adjacent said bottom;

at least one substantially stationary feed pipe having at least a first portion thereof extending at least partially vertically in said tower interior upwardly away from said bottom; and said at least one substantially stationary feed pipe first portion having a plurality of openings therein which allow flow of pulp from the feed pipe into said tower interior, said openings spaced different distances from said bottom so that said openings are at different heights within said tower interior.

6. A pulp tower as recited in claim 5 wherein said at least one feed pipe comprises a first feed pipe having a first diameter and a second feed pipe substantially concentric with said first feed pipe and having a second diameter larger than said first diameter, and wherein said second feed pipe has said plurality of different height openings and said first feed pipe has a single height opening.

7. A pulp tower as recited in claim 6 wherein said first feed pipe extending downwardly into said second feed pipe and discharges pulp downwardly into said second feed pipe.

8. A pulp tower as recited in claim 6 wherein said first feed pipe extends upwardly into said second feed pipe, and pulp flows from a top portion of said first feed pipe into said second feed pipe.

9. A pulp tower as recited in claim 5 wherein said feed pipe has a side wall and a top, and wherein said plurality of openings includes at least one opening in said side wall of said feed pipe, and an open top of said feed pipe.

10. A pulp tower as recited in claim 5 further comprising at least one guide associated with at least one of said feed pipe openings for guiding the flow of pulp through said opening into said tower interior in a substantially horizontal direction.

11. A pulp tower as recited in claim 10 wherein said at least one guide is located below a feed pipe opening with which it is associated.

12. A pulp tower as recited in claim 10 wherein said guide comprises a baffle.

13. A pulp tower as recited in claim 10 wherein said at least one guide is located above a feed pipe opening with which it is associated.

14. A pulp tower as recited in claim 5 wherein said at least one feed pipe comprises a single feed pipe substantially concentric with said tower interior.

15. A pulp tower as recited in claim 14 wherein said feed pipe has at least two different diameter portions with a transition therebetween, and wherein one of said openings is provided at each transition.

16. A pulp tower as recited in claim 15 wherein said different diameter portions are consecutively larger the further said portions are spaced from said tower bottom.

17. A pulp tower as recited in claim 15 wherein said different diameter portions are consecutively smaller the further said portions are spaced from said tower bottom.

18. A pulp tower as recited in claim 5 wherein said at least one feed pipe comprises a side wall; and wherein at least some of said openings are provided in said side wall.

19. A pulp tower as recited in claim 18 wherein said openings are substantially diamond shaped and provided in a plurality of substantially vertically spaced rows with a plurality of openings in each row.

20. Apparatus for supplying pulp to a pulp tower, the pulp tower having a bottom and a side wall, defining a tower interior; said apparatus comprising:

at least one substantially stationary feed pipe having at least a first portion thereof extending at least partially vertically in said tower interior upwardly away from the tower bottom; and said at least one substantially stationary feed pipe first portion having a plurality of openings therein which allow flow of pulp from the feed pipe into the tower interior, said openings spaced different distances from the tower bottom so that said openings are at different heights within the tower interior.

21. Apparatus for supplying pulp to a pulp tower as recited in claim 20 wherein said at least one feed pipe comprises a first feed pipe having a first diameter and a second feed pipe substantially concentric with said first feed pipe and having a second diameter larger than said first diameter, and wherein said second feed pipe has said plurality of different height openings and said first feed pipe has a single height opening.

22. Apparatus for supplying pulp to a pulp tower as recited in claim 20 wherein said feed pipe has a side wall and a top, and wherein said plurality of openings includes at least one opening in said side wall of said feed pipe, and an open top of said feed pipe.

23. Apparatus for supplying pulp to a pulp tower as recited in claim 20 further comprising at least one guide associated with at least one of said feed pipe openings for guiding the flow of pulp through said opening into the tower interior in a substantially horizontal direction.

24. Apparatus for supplying pulp to a pulp tower as recited in claim 20 wherein said at least one feed pipe comprises a single feed pipe substantially concentric with said tower interior.

25. Apparatus for supplying pulp to a pulp tower as recited in claim 24 wherein said feed pipe has at least two different diameter portions with a transition therebetween, and wherein one of said openings is provided at each transition.

26. Apparatus for supplying pulp to a pulp tower as recited in claim 20 wherein said at least one feed pipe comprises a side wall and wherein at least some of said openings are provided in said side wall and are substantially circular or substantially diamond shaped.

* * * * *